US006012579A

United States Patent [19]

Tindoll et al.

[11] Patent Number: 6,012,579

[45] Date of Patent: Jan. 11, 2000

[54] CORNER PROTECTOR FOR FLAT MATERIAL

[76] Inventors: Avalon Tindoll, P.O. Box 494 133 Rd. 1376, Tupelo, Miss. 38802; Stanley Hendrix, 31 Amelia La., Tupelo, Miss. 38801

[21] Appl. No.: 09/165,384

[22] Filed: Oct. 2, 1998

[51] Int. Cl.[7] ..... B65D 85/30

[52] U.S. Cl. ..... 206/453; 206/586; 428/35.2

[58] Field of Search ..... 206/453, 522, 206/586; 383/3; 428/35.2

[56] References Cited

U.S. PATENT DOCUMENTS

| | | | |
|---|---|---|---|
| 2,728,451 | 12/1955 | Leander . | |
| 2,885,139 | 5/1959 | Werner et al. . | |
| 3,144,236 | 8/1964 | Clanin . | |
| 3,302,782 | 2/1967 | Pezely, Jr. . | |
| 3,446,345 | 5/1969 | Frosoy . | |
| 4,063,702 | 12/1977 | Wilde et al. . | |
| 5,099,991 | 3/1992 | Kitagawa et al. . | |
| 5,447,233 | 9/1995 | Smith . | |
| 5,547,075 | 8/1996 | Hoogerwoord | 206/522 |
| 5,549,944 | 8/1996 | Abate | 206/35.2 |
| 5,639,523 | 6/1997 | Ellis | 428/35.2 |
| 5,692,607 | 12/1997 | Brosmith et al. | 206/522 |
| 5,791,476 | 8/1998 | Stekloff | 206/522 |

*Primary Examiner*—Jim Foster
*Attorney, Agent, or Firm*—Young & Thompson

[57] ABSTRACT

A corner protector for flat material, comprises a pair of layers of plastic bubble sheet, preferably air bubble plastic sheet, superposed on each other and open along one edge and closed along at least one other edge by securement of the layers against each other. The protector is triangular and open on one side and closed on the other two sides. Those two other sides are edges formed by heat welding together the two layers of plastic bubble sheet. Preferably, the protector is a right triangle having one corner a right angle and the open side opposite that right angle. The bubbles occupy most of the area of the protector.

5 Claims, 2 Drawing Sheets

CORNER PROTECTOR FOR FLAT MATERIAL

FIELD OF THE INVENTION

The present invention relates to corner protectors for flat material.

BACKGROUND OF THE INVENTION

Corner protectors for flat material are known, which are generally triangular in shape and slip over the corner of the material to be protected.

Such corner protectors often offer excellent protection from potentially damaging forces applied in a direction perpendicular to the material of the corner. However, in the case of flat material, such corner protectors leave much to be desired in protecting the flat material from blows or other stresses applied in a direction parallel to the plane of the flat material, with the result that the edges of the flat material can become nicked, bent or dented by such forces applied in that direction.

OBJECT OF THE INVENTION

It is accordingly an object of the present invention to provide a corner protector for flat material which gives enhanced protection to the material against blows or other forces applied in a direction parallel to the plane of the material.

Another object of the present invention is to provide a corner protector for flat material that can easily be applied to and retained on the material without the need for special attachment to the material.

Finally, it is an object of the present invention to provide a corner protector for flat material, which will be simple in construction, easy to manufacture from readily available materials, of low cost, and rugged and durable in use.

Other objects and advantages of the present invention will become apparent from the description that follows.

DEFINITION OF TERMS

As used in the text that follows, certain terms are to be understood to have the following meanings:

"Flat material" includes, in addition to sheet material, objects having one dimension substantially less then the other two and specifically includes mirrors and picture frames.

"Material" means not only a unitary material such as a sheet of cardboard or plywood, but also composite material as in mirrors or picture frames.

"Corner" includes, in addition to right-angle corners, corners of other angles, formed or not from intersecting edges that may be straight or curved but of which at least portions of such edges are disposed at an angle to each other. Thus, "corner" does not include a single straight edge.

"Plastic bubble sheet" includes flexible sheets of foamed plastic such as polyethylene, and air bubble plastic sheets.

"Air bubble plastic sheet" includes, but is not limited to, thermoplastic flexible sheet material, such as polyvinyl chloride, polypropylene, etc., ordinarily formed by placing together two sheets of such plastic and heat welding them together whilst trapping between them bubbles of a size such that most of the area of the sheet is occupied by such bubbles. Such sheets may be faced on one or both sides with an added sheet of such plastic.

SUMMARY OF THE INVENTION

The invention is the discovery that improved protection of corners of flat material can be achieved, by providing a corner protector comprised of two layers of plastic bubble sheet that, in their undeformed condition, lie flat against each other and are secured together part way about their edges so as to form a pocket and to leave one edge of the pocket open to receive a corner to be protected. At least one of the secured edges of the pair of sheets is formed by securing together two adjacent edges of the sheets by heat welding or adhesively, preferably by heat welding. It is also preferred that all the closed edges of the protector be thus secured together.

Although plastic bubble sheet is old, nevertheless, in the present invention, it functions in several quite new ways. The plastic is of low coefficient of friction with most of the materials it is to protect and so readily slides relative to the protected material. Moreover, when in contact with the protected material, it is mainly the crests of the bubbles that contact the protected material, which further reduces frictional forces between the protected material and the protecting material in a direction parallel to their common plane. Still further, the securement together of separate sheets along the closed edges of the protector, particularly by heat welding, increases the difficulty of inserting a corner to be protected, into the protector, because the sheets are held tightly together in the vicinity of the edge joints between the sheets. This means that the protected corner can only forcibly be brought into full seating within the protector, as the force necessary to deform the sheets and more particularly to deform the bubbles on the sheets, must be overcome.

Conversely, when the force that presses the corner protector onto the protected corner is released, the deformation force, aided by the low coefficient of friction of the plastic and the reduced area of contact between the protector and the protected corner thanks to the presence of the bubbles, causes the protector to slide back from fully seated position, in a direction oblique to both edges of the corner in the case of a rectangular corner; and this movement of the corner protector will hereinafter be referred to as "spring-back", because the release of the deformation force causes the protector to spring away from fully seated position in a direction opposite the direction in which the protector was applied.

This springback is very important to the invention, because, in order to reverse the springback, there must again be applied a force having at least a component in a direction opposite to the direction of springback. This force can for example be a force which otherwise would damage the edge of the protected article; and in any event, even if this force is sufficient to overcome the springback, the potentially damaging force to be applied to the edge of the protected material will be reduced by the force necessary to reverse the springback, and so a corresponding measure of additional protection is given to the protected material.

In other words, the present invention adds to the protective effect previously achieved by other corner protectors, a new protective effect equal to the force necessary to cause the corner protector to move from its springback position to a position in which the protected corner is fully seated in the protector.

Thus, the present invention does not change plastic bubble sheet itself in any way: commercially available plastic bubble sheet is entirely satisfactory for use in the present invention. Instead, the present invention uses known plastic bubble sheet in a new form to achieve a new result, relying on properties of plastic bubble sheet that have not previously been used for protective purposes, namely, its low coefficient of friction and its reduced area of contact in combination with its resistance to deformation by relative movement in a direction parallel to its plane.

As plastic bubble sheet, air bubble plastic sheet is particularly preferred, because of the large size of its bubbles, its flexibility, its relatively great thickness, and its high elasticity in resistance to the insertion of flat material into a corner protector as described above.

BRIEF DESCRIPTION OF THE DRAWINGS

The above and other features of the present invention will become more apparent from a consideration of the following description, taken in connection with the accompanying drawings, in which.

DETAILED DESCRIPTION OF THE INVENTION

Figure 1:
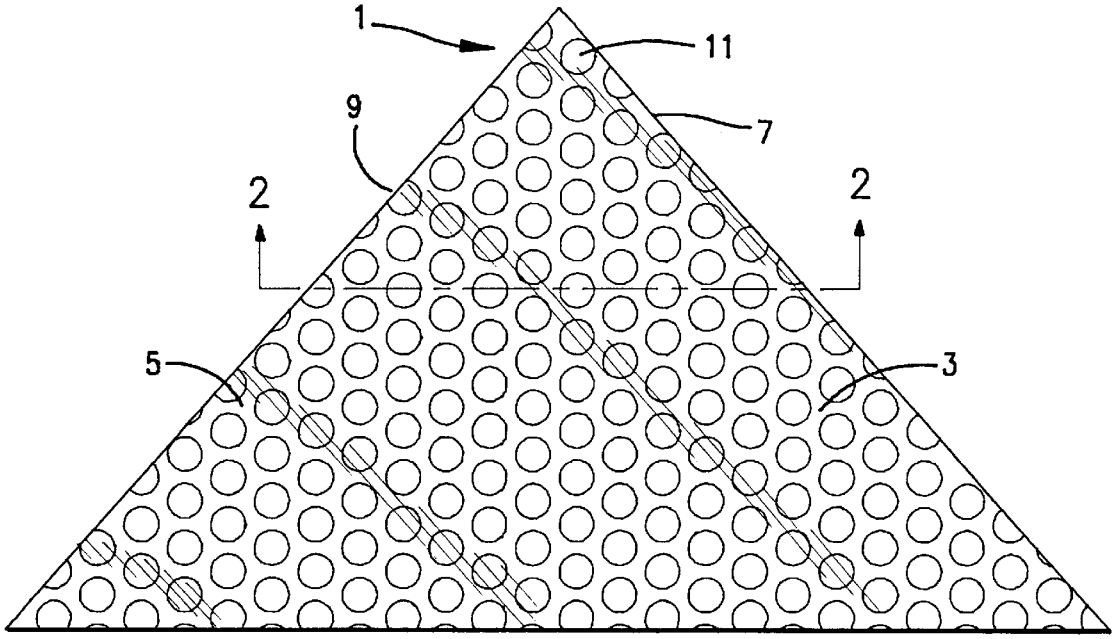
FIG. 1 is an elevational view of a corner protector for sheet material according to the invention.
Figure 2:
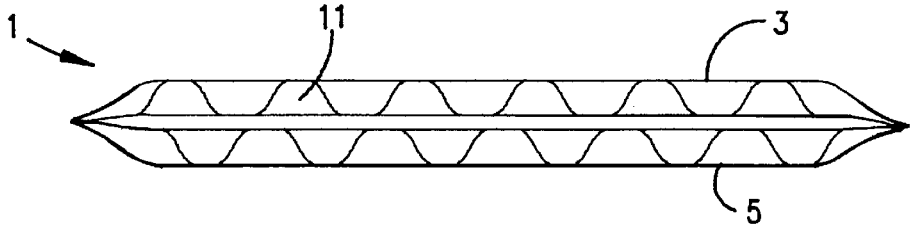
FIG. 2 is a fragmentary cross sectional view taken on the line 2—2 FIG. 1.
Figure 3:
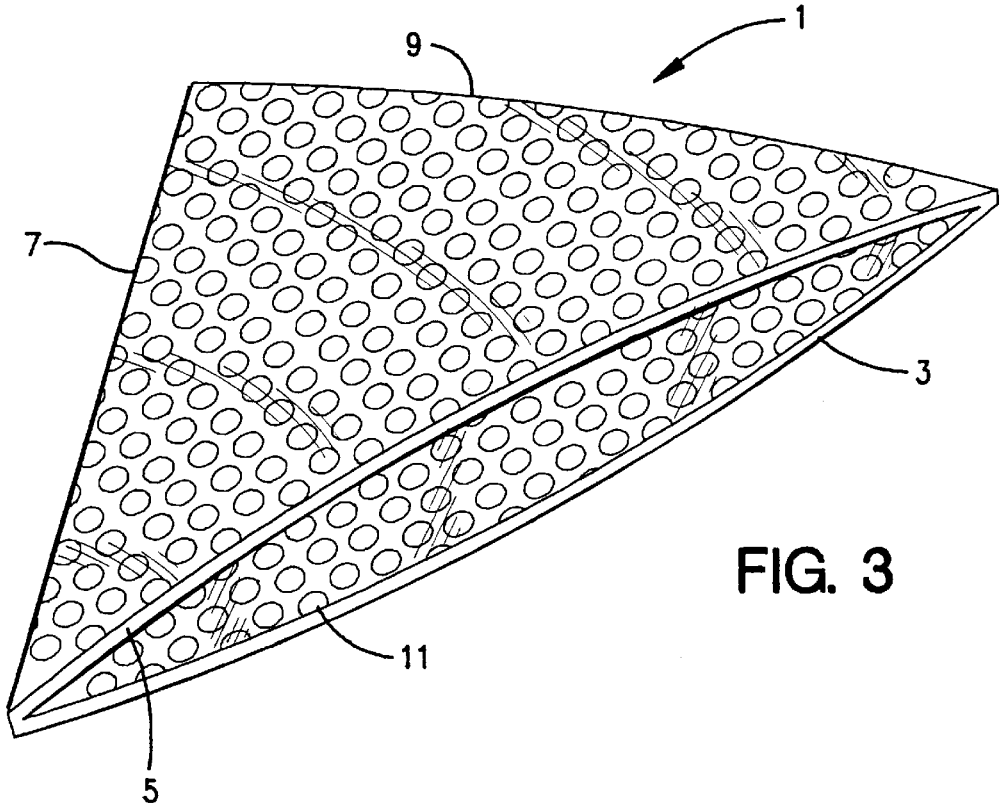
FIG. 3 is a view similar to FIG. 1 but showing in perspective a corner protector according to the invention in open condition ready to receive a corner to be protected.

Referring now to the drawings in greater detail, there is shown in FIG. 1 a corner protector 1 according to the invention, comprising a pair of superposed sheets 3 and 5 of plastic bubble sheet which, according to the preferred embodiment, are air bubble plastic. In a preferred embodiment, protector 1 will be triangular, and ordinarily will have a right angular apex at the intersection of edges 7 and 9 thereof along at least one of which the two sheets 3 and 5 are secured to each other by heat welding or adhesive, preferably heat welding. If one of the edges 7 and 9 is formed by folding over a single triangular sheet about its axis of symmetry, then the springback effect is correspondingly reduced.

As mentioned above, each sheet 3 and 5 is formed by the juxtaposition and securement together of two individual sheets thereby to leave bubbles 11 which are closed by areas of these latter two sheets that are secured to each other. A third sheet can be secured to the crests of the bubbles, so that both sides of each sheet 3 and 5 will be comprised by a continuous sheet which will, however, be bumpy because of the underlying bubbles. Ordinarily, the total area of bubbles 11 will be most of the area of sheet 3 or sheet 5. The superposed sheets 3 and 5 will accordingly contact each other mainly at points corresponding to their respective bubbles 11.

Flat material 13 can be inserted in protector 1 from the open side thereof, and the received edges of material 13 can thus be brought close to closed edges 7 and 9 of protector 1 only with the application of increasing force in a direction parallel to the common plane of protector 1 and material 13. This increasing force is due to the fact that the edges 7 and/or 9 are formed by edges of the respective sheets 3 and 5 that are pressed flat against each other and secured together in that condition, preferably by heat welding because it is cheaper and quicker than the use of adhesive. To move toward an edge 7 or 9, therefore, the material 13 must deform bubbles 11 with a progressively greater force.

Figure 4:
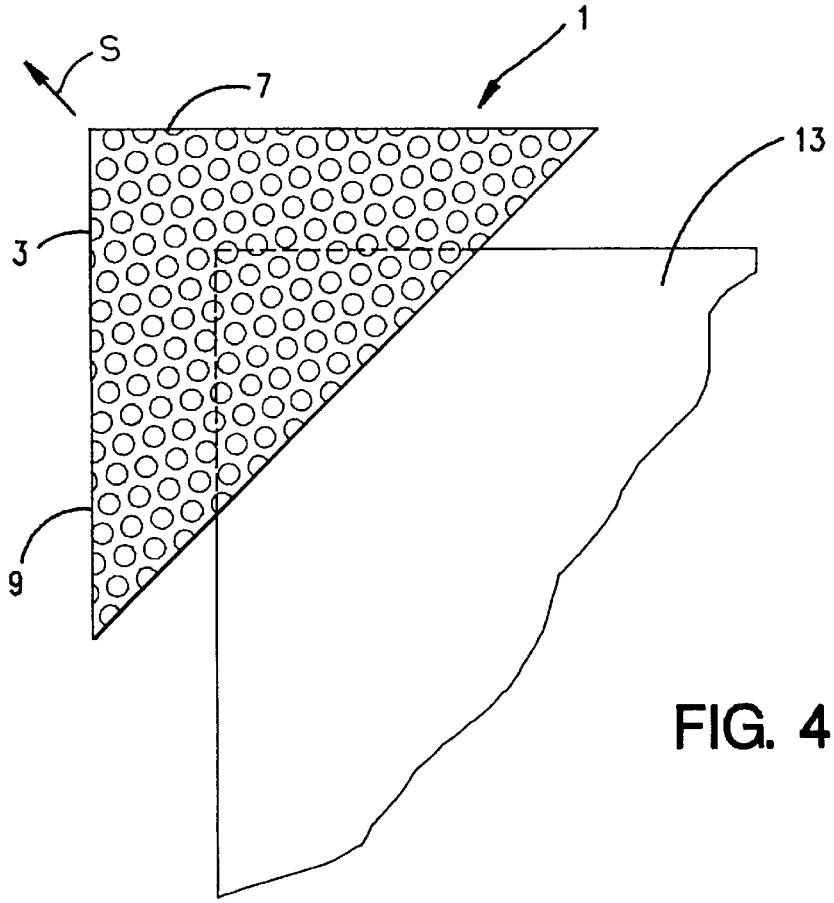
FIG. 4 is a view showing the combination of a corner protector according to the invention and flat material of which a corner is protected thereby.

The assembly of protector 1 and material 13 is accordingly an unstable one, because to maintain material 13 fully seated in protector 1 requires the application of force. If such force is released, then protector 1 tends to spring a back from the protected corner of material 13, the direction of this springback being indicated by the arrow S in FIG. 4. This springback thus relieves the force necessary to maintain the unstable arrangement of material 13 fully seated in protector 1, and the protector 1 will reach an equilibrium position in which the greatly reduced force needed to retain it on a corner of material 13 will be no greater than the frictional force between the points corresponding to the crests of the bubbles 11 and the protected material 13.

Upon application of an otherwise damaging blow in a direction parallel to the plane of material 13, such blow, if it strikes protector 1, will first have to seat protector 1 fully on protected material 13 in at least one direction parallel to an edge of material 13 or with a component of force in a direction opposite springback direction S. Only after this amount of the force of the damaging blow has been absorbed, can there be any force remaining to be applied to the protected edge of material 13. Damage to that protected edge will accordingly be reduced or avoided.

The resistance of the plastic bubble sheet and more particularly air bubble plastic sheet to deformation by relative movement of an object parallel to the plane of the sheet, is thus used to provide a new corner protector according to the invention operating in a new manner to achieve a new result.

In view of the forgoing description, therefore, it will be evident that all the initially recited objects of the present invention have been achieved.

Although the present invention has been described and illustrated in connection with preferred embodiments, it its is to be understood that modifications and variations may be resorted to, without departing from the spirit of the invention. Such modifications and variations are considered to be within the scope of the present invention as defined by the appended claims.

We claim:

1. A corner protector for flat material, comprising a pair of triangular layers of plastic bubble sheet superposed on each other and open along one edge and closed along two other edges by securement of the layers of plastic bubble sheet against each other.

2. A protector as claimed in claim 1, the total area of bubbles occupying most of the area of said protector.

3. A protector as claimed in claim 1, wherein said plastic bubble sheet is air bubble plastic sheet.

4. A protector as claimed in claim 1, wherein said two other edges are formed by heat welding together said two layers of plastic bubble sheet.

5. A protector as claimed in claim 1, which is a right triangle having a right angle at a junction between said two other edges.

* * * * *